US006241048B1

(12) United States Patent
Heilmann

(10) Patent No.: US 6,241,048 B1
(45) Date of Patent: Jun. 5, 2001

(54) STORAGE PLATFORM AND LIFT APPARATUS

(76) Inventor: Joseph John Heilmann, 14525 Bluebird Trail, NE., Prior Lake, MN (US) 55372

( * ) Notice: Subject to any disclaimer, the term of this patent is extended or adjusted under 35 U.S.C. 154(b) by 0 days.

(21) Appl. No.: 09/442,197

(22) Filed: Nov. 16, 1999

(51) Int. Cl.[7] ..... B66B 11/06; E04H 6/18

(52) U.S. Cl. ..... 187/263; 187/213; 187/254; 187/256; 414/228; 414/233; 254/286; 254/311; 312/313; 108/106

(58) Field of Search ..... 187/250, 251, 187/252, 254, 255, 256, 259–264, 266, 240–244, 210, 213, 216; 254/286, 311, 312, 321, 294, 4 R, 4 B, 4 C; 312/246, 247, 313; 108/106, 147, 109, 147.15; 414/228, 229, 233, 234

(56) References Cited

U.S. PATENT DOCUMENTS

| | | | | |
|---|---|---|---|---|
| Re. 6,993 | * | 3/1876 | Hinkle | 187/263 |
| Re. 32,118 | * | 4/1986 | Godbersen | 187/213 X |
| 136,698 | * | 3/1873 | Brown | 254/286 X |
| 170,087 | * | 11/1875 | Howard | 187/263 X |
| 466,629 | * | 1/1892 | Smith | 254/286 |
| 778,259 | * | 12/1904 | Milne | 254/286 X |
| 831,518 | * | 9/1906 | McCarthy | 187/213 X |
| 1,118,241 | * | 11/1914 | Sigafoos | 254/311 X |
| 1,338,127 | | 4/1920 | Felt . | |
| 1,484,389 | * | 2/1924 | Folkers | 254/286 X |
| 1,545,426 | * | 7/1925 | Hoffmann | 414/233 |
| 2,242,891 | * | 5/1941 | Light | 414/233 |
| 2,455,507 | * | 12/1948 | Light | 254/312 X |
| 2,643,662 | | 6/1953 | Bunce . | |
| 3,139,266 | | 6/1964 | Tew . | |
| 3,358,300 | * | 12/1967 | Smith | 108/106 X |
| 3,395,777 | * | 8/1968 | Rodosta | 187/213 |
| 3,627,397 | | 12/1971 | Rominsky . | |
| 3,661,415 | | 5/1972 | Piasecki . | |
| 3,697,048 | | 10/1972 | Sarno . | |
| 3,929,371 | * | 12/1975 | Gibson | 108/109 X |
| 4,109,896 | | 8/1978 | Ragen . | |
| 4,588,048 | | 5/1986 | Rodriguez . | |
| 4,674,938 | * | 6/1987 | Van Stokes et al. | 414/228 |
| 4,826,384 | * | 5/1989 | Okura et al. | 414/233 X |
| 5,203,619 | | 4/1993 | Welsch et al. . | |
| 5,224,569 | | 7/1993 | Hewitt et al. . | |
| 5,497,584 | * | 3/1996 | Fang | 187/213 |
| 5,535,852 | | 7/1996 | Bishop et al. . | |
| 5,772,360 | | 6/1998 | Wood, II . | |
| 5,871,070 | | 2/1999 | Contreras . | |

FOREIGN PATENT DOCUMENTS

| | | | | |
|---|---|---|---|---|
| 609545 A5 | * | 3/1979 | (CH) | 312/247 |
| 3919402 | * | 3/1990 | (DE) | 312/247 |
| 1051805 | | 1/1954 | (FR) . | |
| 2275400 | | 1/1976 | (FR) . | |
| 4-281968 | * | 10/1992 | (JP) | 414/228 |
| 5-113046 | * | 5/1993 | (JP) | 414/228 |
| 5-133124 | * | 5/1993 | (JP) | 414/233 |

* cited by examiner

*Primary Examiner*—Christopher P. Ellis
*Assistant Examiner*—Thuy V. Tran
(74) *Attorney, Agent, or Firm*—Michael A. Mochinski

(57) ABSTRACT

A storage platform and lift apparatus comprises a plurality of platforms; four cables; a plurality of elongated brace members; four elongated vertical members, each having a plurality of apertures extending therethrough; and a drive axle. A pulley wheel is rotatably coupled to two vertical members, while the other two vertical members support a drive axle which contains the four cables. A plurality of brace members support the vertical members in an upright, stable position. Upper and lower gear assemblies, in combination with the four cables extending outwardly away from the drive axle and coupled to the platforms, provide means to raise and lower the platforms to any desired height for either short- and long-term storage of machinery, equipment, and the alike.

20 Claims, 5 Drawing Sheets

STORAGE PLATFORM AND LIFT APPARATUS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to a storage lift apparatus for storing machinery, equipment and the alike. More particularly, the present invention relates to a new and improved storage apparatus having multiple platforms which are conveniently lowered to permit loading and unloading of machinery, equipment and the alike, and are conveniently raised to permit short- and long-term storage of the same as well as to provide for additional storage area below the raised platforms.

BACKGROUND OF THE INVENTION

The utilization of storage and lifting devices is well known in the art. However, most, if not all, do not have ample area to store large, heavy machinery, equipment and the alike on multiple platforms. In some cases, storage is accomplished by lifting the platform well above the floor level into the ceiling area, such as can be seen in U.S. Pat. No. 5,871,070 to Contreras, which discloses an overhead storage lift assembly. However, in most cases, articles are simply stored on overhead shelves or racks, or on the floor.

Accordingly, there still remains the need for a storage platform and lift apparatus that is capable of storing heavy equipment and machinery above the ground level on multiple platforms as well as allowing continued use of the space occupied by the storage platform and lift apparatus. For instance, the front portion of an automobile can be conveniently positioned and stored within the area defined by the present invention while articles are stored thereabove on multiple platforms.

BRIEF SUMMARY OF THE INVENTION

It is therefore an object of the present invention to provide a new and improved storage platform and lift apparatus which can safely and easily raise or lower objects for both short- and long-term storage.

It is also an object of the present invention to provide a new and improved storage platform and lift apparatus which is simple in construction, inexpensive and easy to install.

It is another object of the present invention to provide a new and improved storage platform and lift apparatus which permits continued use of the space occupied by the present invention.

It is also another object of the present invention to provide a new and improved storage platform and storage lift apparatus which permits the use of multiple storage platforms.

It is yet another object of the present invention to provide a new and improved storage platform and lift apparatus which may be easily and efficiently manufactured and marketed.

An even further object of the present invention to provide a new and improved storage platform and lift apparatus which is of durable and reliable construction.

To achieve these objects, and others, the present invention essentially comprises a new and improved storage platform and lift apparatus comprising, in combination: first and second elongated vertical members formed in a generally rectangular configuration with two side faces, an outer side face and an inner side face, each vertical member further including a plurality of apertures extending therethrough and a top end including a top pulley wheel rotatably coupled thereto; a plurality of platforms each formed in a planer generally rectangular configuration and including a reinforced outer periphery with two platform sides, each side having a pair of coupling means, the reinforced outer periphery further including a plurality of apertures extending therethrough; a plurality of guide wheels rotatably coupled to the reinforced outer periphery and engaged with that of the vertical members to permit proper alignment of the platform during the raising and lowering thereof; third and fourth elongated vertical members formed in a generally rectangular configuration with two side faces, an outer side face and an inner side face, each vertical member further including a plurality of apertures extending therethrough and a top end including a top bracket assembly attached thereto, each top bracket assembly comprising a bearing housing, a bearing and a bearing collar, the bearing and bearing collar being formed in a generally circular configuration, the third vertical member further comprising a lower drive gear assembly and a locking ratchet assembly, both of which being mounted onto a box-like structure having a plurality of walls, the lower drive gear assembly comprising a lower spur gear, a keyed gear shaft and a handle, the keyed gear shaft having an outboard end and extending through the walls of the box-like structure, the handle being fixedly attached to the outboard end of the keyed gear shaft to permit rotation of the lower spur gear about the longitudinal axis of the keyed gear shaft, the locking ratchet assembly comprising a locking ratchet, a ratchet spacer and an elongated bolt, the lower drive gear assembly further comprising a locking ratchet gear, a pair of lower gear spacers, a gear shaft stop, and a friction pad, the ratchet gear being formed in a generally circular configuration and having a plurality of protruding teeth extending radially therefrom, the teeth being in engagement with the locking ratchet to prevent rotation of the lower spur gear, the ratchet spacer and bolt being configured to permit proper alignment for full engagement of the teeth of the ratchet gear with that of the locking ratchet, the friction pad having an aperture running therethrough to permit mounting onto the keyed gear shaft, the lower gear spacers being positioned on each side of the ratchet gear to permit clearance of the ratchet gear while in rotational motion, the gear shaft stop being fixedly attached to the keyed gear shaft to prevent lateral movement thereof, a plurality of horizontal brace members having ends fixedly attached to the vertical members to support the vertical members in an upright, stable position; a pair of upper and bottom diagonal braces being fixedly attached to the vertical members and horizontal brace members to increase stability of the vertical members, an elongated drive axle having a pair of ends, a keyed end and a distal end, and a plurality of disk-shaped dividers spaced about the drive axle, the keyed and distal ends being rotatably engaged with top bracket assemblies of third and fourth vertical members, the drive axle extending perpendicularly through the outer and inner side faces of the third vertical member, the drive axle further including an upper drive gear assembly fixedly attached to the keyed end, the upper drive gear assembly comprising an upper spur gear, a shaft pin, and a gear hub positioned between the outer side face of the third vertical member and upper spur gear; a drive gear chain having a plurality of links in meshing communication with the upper and lower spur gears; a plurality of elongated pins formed in a generally cylindrical configuration, the pins being situated within the apertures of the vertical members and the apertures of the reinforced outer periphery to lock the platforms in a preferred static position; and first, second, third, and fourth cables each being formed in an elongated cylindrical configuration, each cable being positioned around the drive axle between the disk-shaped dividers, the first cable extending outwardly from the drive axle over the top pulley wheel of the second vertical member and being coupled to the platform side positioned between the first and second vertical members, the second cable extending downwardly from the drive axle and being coupled to the platform side positioned between the third and fourth vertical members, the third cable extending outwardly from the drive axle over the top pulley wheel of the first vertical member and being coupled to the platform side positioned between the first and second vertical members, the fourth cable extending downwardly from the drive axle and being coupled to the platform side positioned between the third and fourth vertical members.

The present invention is particularly advantageous for use with a garage or similar storage area where space is limited, insofar as it is relatively simple in construction, utilizes inexpensive materials and components, and is very easy to install. These advantages are very important to the average homeowner interested in economical and useful improvement to his or her residence.

There has been described, rather broadly, the more important features of the present invention in order that the detailed description thereof that follows may be better understood, and in order that the present contribution to the art may be better appreciated.

It is understood that the present invention is not limited in its application to the details of construction and the arrangements of the components set forth in the following description or illustrated in the drawings. The present invention is capable of other embodiments and of being practiced and carried out in several ways. Further, it is to be understood that the phraseology and terminology employed herein are for the purpose of description and should not be regarded as limiting the scope of the present invention.

The foregoing objects of the present invention, combined with the various features of novelty which characterize the present invention, are pointed out with particularly in the claims annexed to and forming a part of this disclosure. For a greater understanding of the present invention, reference should be made to the accompanying drawings and descriptive matter in which there is illustrated the preferred embodiment of the present invention.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

Figure 1:
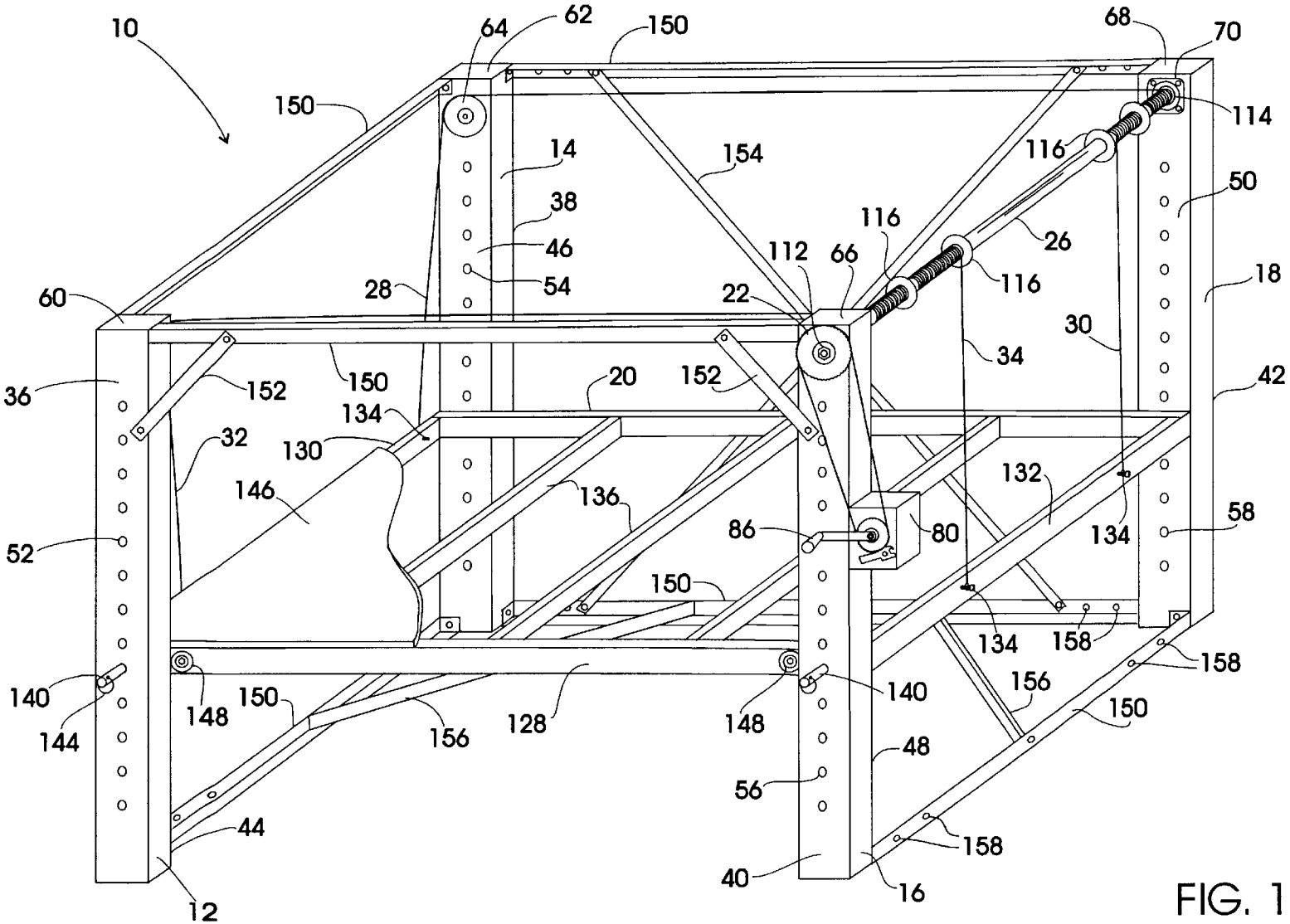
FIG. 1 is a perspective view of the preferred embodiment of the storage platform and lift apparatus constructed in accordance with the principles of the present invention.

While this invention is susceptible of being embodied in many different forms, preferred embodiment of the invention is shown in the drawings and described in detail hereinafter with the understanding that the present disclosure is to be considered to exemplify the principles of the present invention and is not intended to limit the invention to the embodiment illustrated.

With reference to the drawings, and in particular, to FIG. 1 thereof, the preferred embodiment of the new and improved storage and lift apparatus embodying the principle concepts of the present invention and generally designated by the reference number 10 will described hereinafter.

In its broadest context, the present invention consists of a first elongated vertical member 12, a second elongated vertical member 14, a third elongated vertical member 16, and a fourth elongated vertical member 18, a plurality of platforms 20, upper and lower drive gear assemblies 22, 24, respectively, an elongated drive axle 26, a first cable 28, a second cable 30, a third cable 32, and a fourth cable 34. Such components are individually configured with respect to each other so as to achieve the desired objectives.

In the preferred embodiment, the vertical members are fabricated of metal and are formed in a generally rectangular configuration with dimensions equating to 96 inches in length, 3.5 inches in width and 2.5 inches in depth. The first, second, third, and fourth elongated vertical members each have two side faces, an outer side face 36, 38, 40, 42, and an inner side face 44, 46, 48, 50 and a plurality of apertures extending therethrough 52, 54, 56, 58, respectively. In the preferred embodiment, each elongated vertical member has thirteen apertures spaced equally about the entire length of the vertical member. The apertures provide means to lock the platforms 20 in a static position. The first and second elongated vertical members further include top ends 60, 62 where a top pulley wheel 64 is rotatably coupled thereto, specifically to the inner side faces 44, 46 of the first and second elongated vertical members, respectively. Each pulley wheel is fabricated of metal or similar type of material capable of withstanding premature wear.

Figure 2:
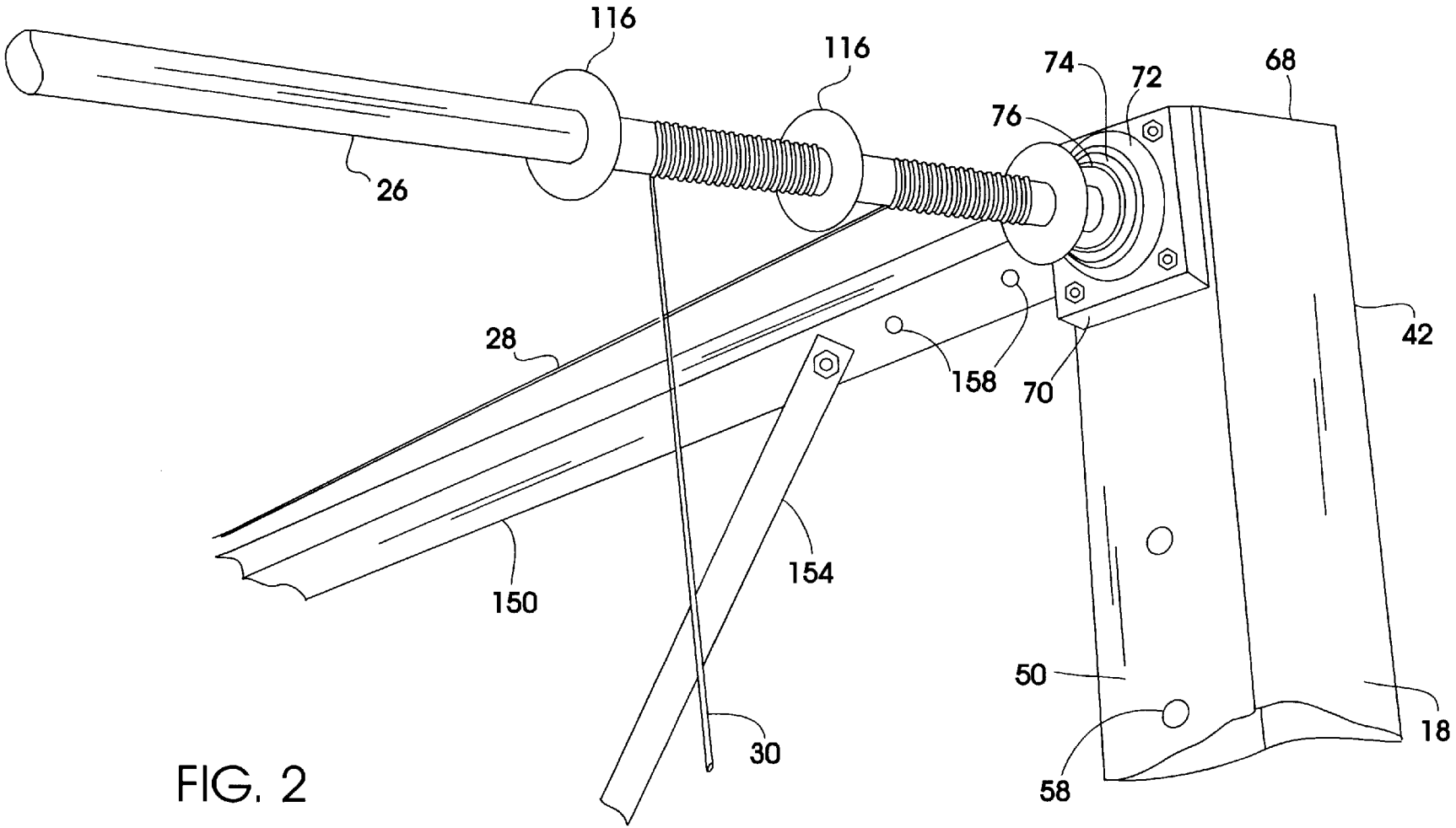
FIG. 2 is a partially broken away perspective view of the preferred embodiment of the storage platform and lift apparatus.

The third and fourth elongated vertical members include top ends 66, 68 and a top bracket assembly 70 fixedly attached thereto, specifically to the inner side faces 48, 50 of the third and fourth elongated vertical members, respectively. Each top bracket assembly includes a bearing housing 72, a bearing 74 and a bearing collar 76. The bearing collar and bearing are formed in a generally circular configuration. The third vertical member further comprises means to raise and lower the platforms, such means include a lower drive gear assembly 24 which is positioned adjacent to the third elongated vertical member. Note FIG. 2.

Figure 3:
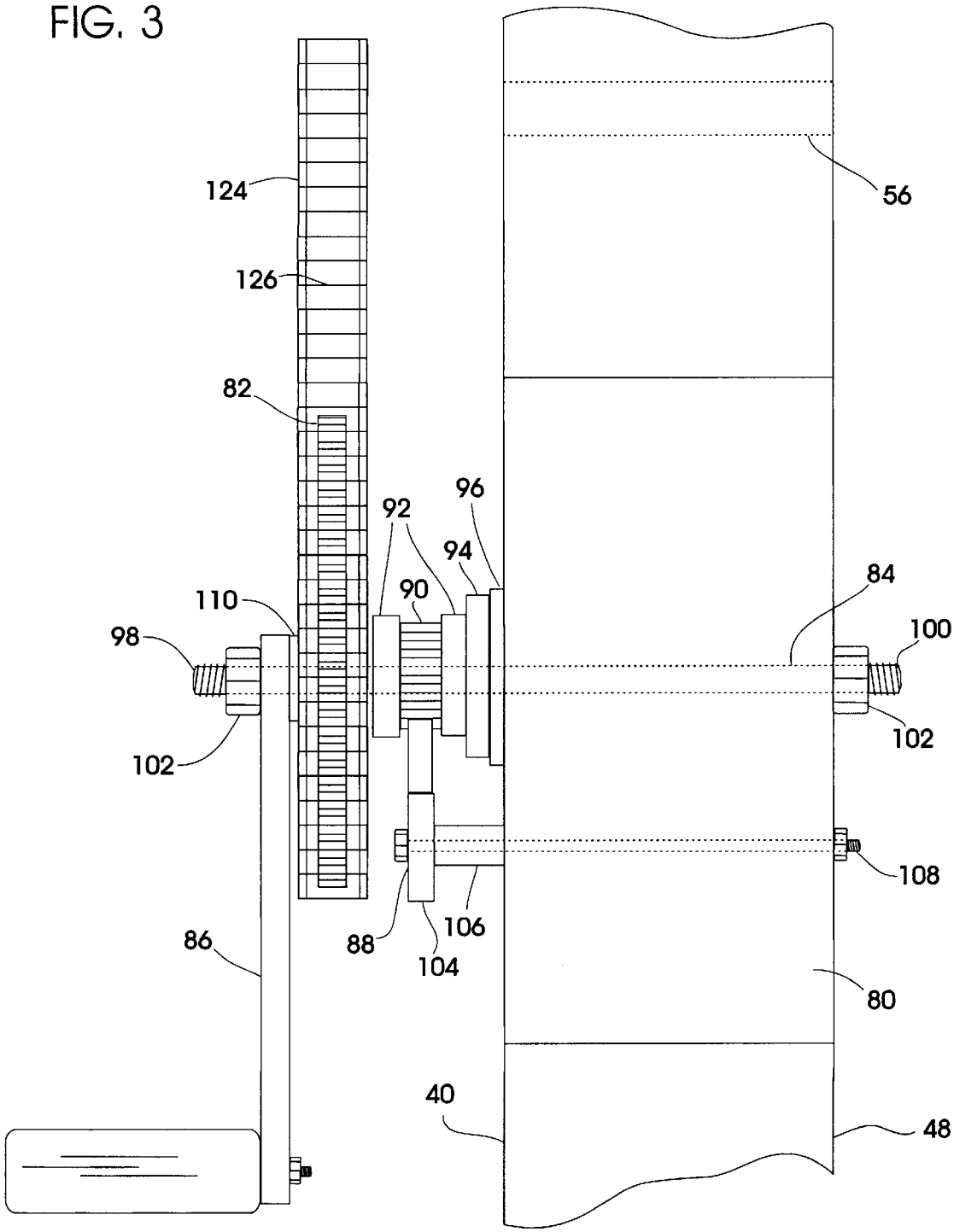
FIG. 3 is a partially broken away side view of the preferred embodiment of the storage platform and lift apparatus.

As seen in FIG. 3, the lower drive gear assembly, which is mounted onto a box-like structure 80, comprises a lower spur gear 82, a keyed gear shaft 84, a handle 86, a locking ratchet assembly 88, a locking ratchet gear 90 having a plurality of teeth extending radially therefrom, a pair of lower gear spacers 92, a gear shaft stop 94, which is preferably pressed on or welded to the gear shaft, and a friction pad 96. The keyed gear shaft extends through the walls of the box-like structure as well as through the lower spur gear, locking ratchet gear, lower gear spacers, gear shaft stop, and friction pad. The keyed gear shaft has an outboard 98 and inboard end 100 where a pair of nuts 102 are attached to prevent lateral movement of the keyed gear shaft during rotation thereof. The locking ratchet assembly 88 includes a locking ratchet 104, a ratchet spacer 106 and an elongated ratchet bolt 108. The locking ratchet is rotatably attached to and spaced away from the wall of the box-like structure by the ratchet spacer and elongated ratchet bolt. The position of the locking ratchet relative to the wall of the box-like structure permits proper alignment for full engagement of the teeth of the locking ratchet gear with that of the locking ratchet. The handle 86 is fixedly attached to the outboard end of the keyed gear shaft to permit rotation of the lower spur gear about the longitudinal axis of the keyed gear shaft and is spaced away from the lower spur gear by a washer 110. Note FIG. 3.

Figure 4:
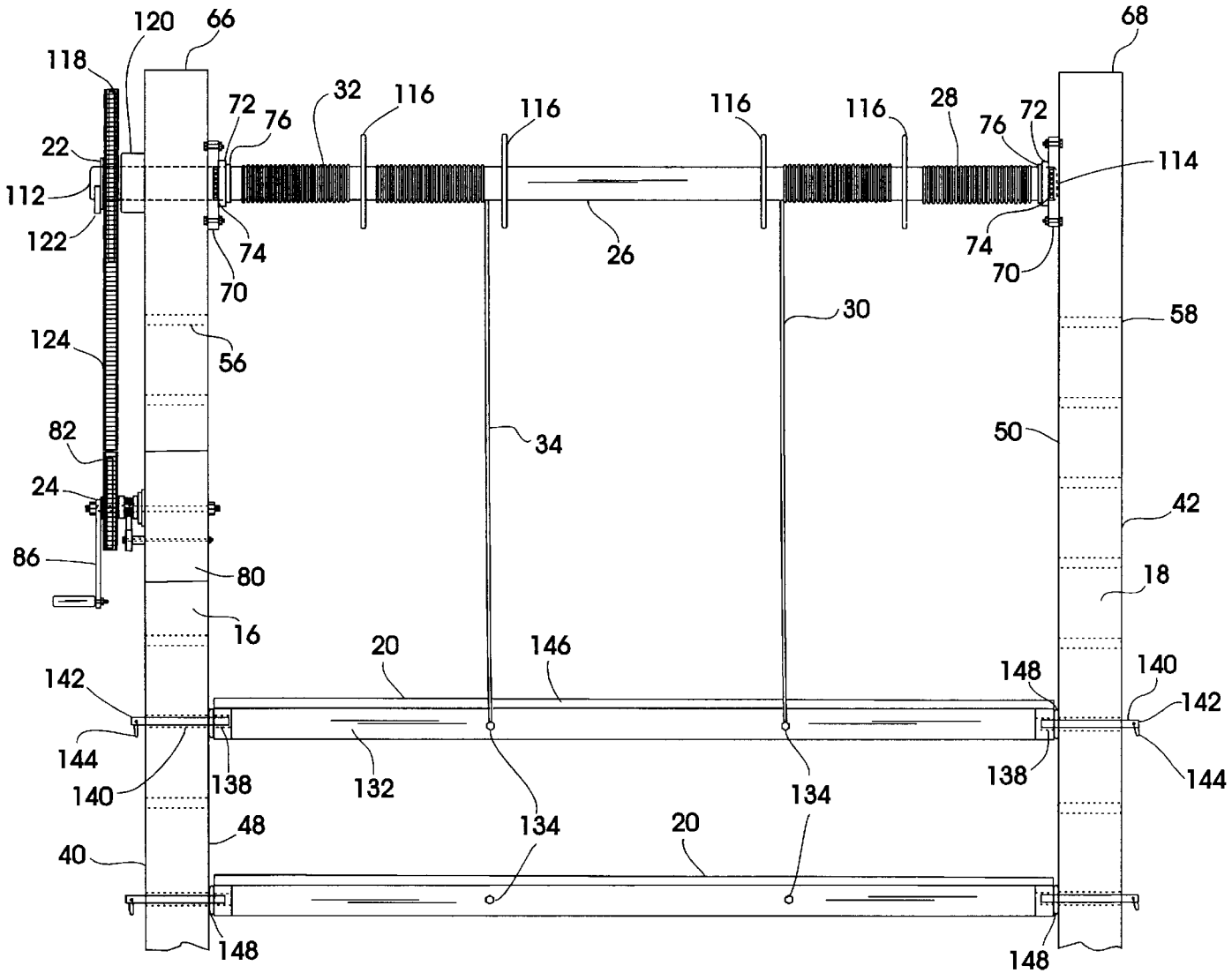
FIG. 4 is a side view of the preferred embodiment of the storage platform and lift apparatus.

Referring now to FIG. 4, the elongated drive axle 26 has a pair of ends, a keyed end 112, a distal end 114, and a plurality of disk-shaped dividers 116 spaced about the drive axle. The keyed and distal ends are rotatably engaged with the top bracket assemblies of the third and fourth elongated vertical members. The drive axle is positioned perpendicularly between the third and fourth elongated vertical members 16, 18, with one end, the keyed end 112, extending entirely through the third elongated vertical member to accept the upper drive gear assembly 22.

As illustrated in FIG. 4, the upper drive gear assembly comprises an upper spur gear 118 and a gear hub 120 positioned between the third vertical member and the upper spur gear. The upper spur gear is fitted to the keyed end 112 of the drive axle to lock the upper spur gear with that of the drive axle to permit unison rotational motion of the upper spur gear and drive axle. A shaft pin 122 is positioned at the keyed end to prevent lateral movement of the upper spur gear while in rotational motion about the longitudinal axis of the drive axle. A drive gear chain 124 having a plurality of links 126 connects the upper spur gear 118 and the lower spur gear 82 so as to permit unison rotation of the drive axle with that of the upper and lower spur gears.

Figure 5:
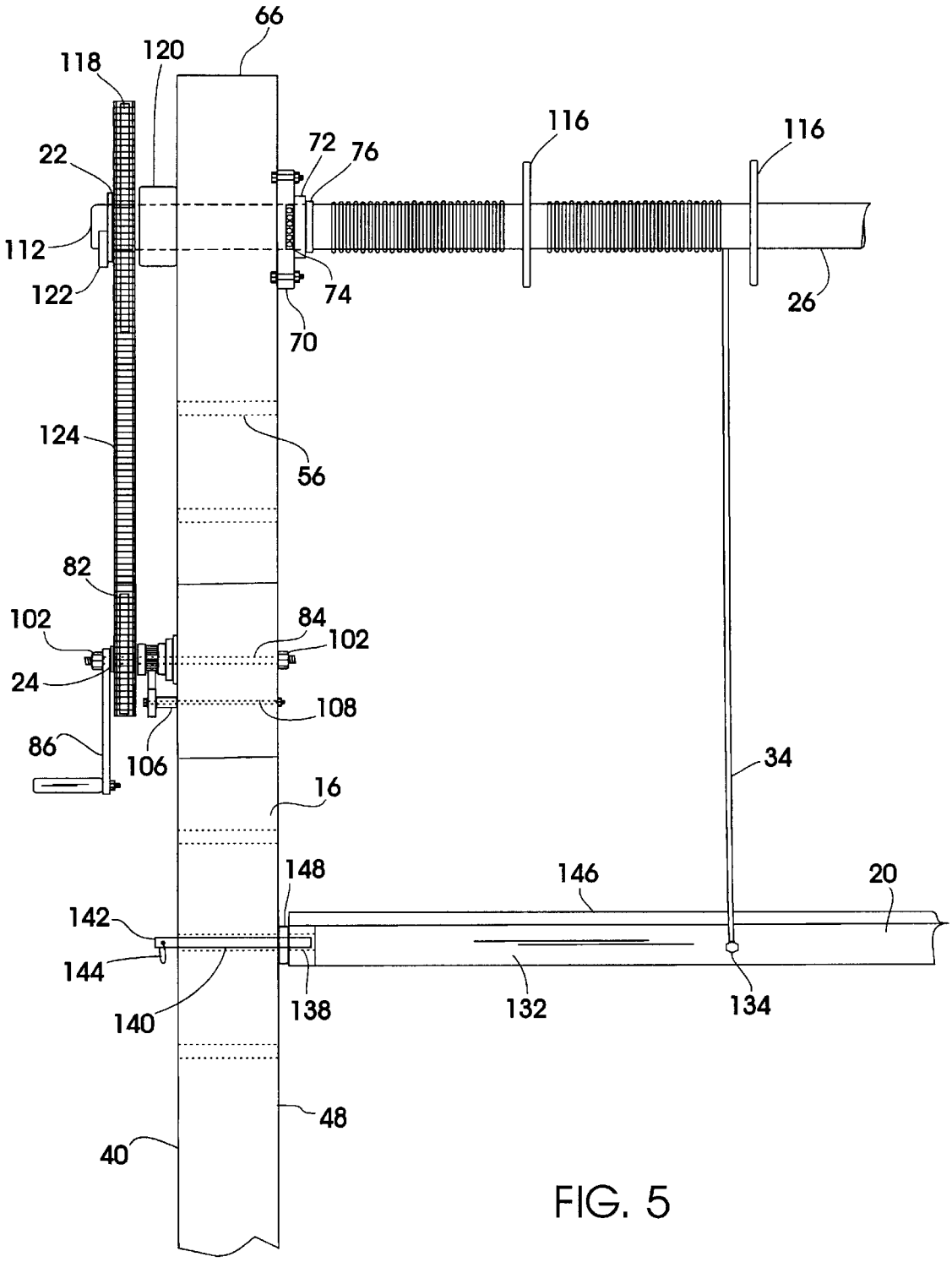
FIG. 5 is a partially broken away side view of the preferred embodiment of the storage platform and lift apparatus.

Each platform 20 is formed in a planer generally rectangular configuration and includes a reinforced outer periphery 128 with two platform sides 130, 132, each of which has a pair of coupling means 134, as depicted in FIGS. 1 and 4. The coupling means include eye or hex-head bolts fixedly attached to the platform sides of the reinforced outer periphery. Each platform further includes a plurality of cross braces 136, preferably three, formed in a generally rectangular configuration, and a plurality of apertures 138, preferably four, each of which being positioned at the comers of the reinforced outer periphery 128. A plurality of elongated pins 140, each formed in a generally cylindrical configuration and having an outboard end 142, are situated within the apertures of the vertical members as well as in the apertures of the reinforced outer periphery to lock each of the platforms in a preferred static position. Each pin includes a ring-like handle 144 at the outboard end 142 to enhance removal of the pins from the apertures of the vertical members and reinforced outer periphery. Note FIG. 5.

Referring now particularly to FIG. 1, in the preferred embodiment, the cross braces 136 are positioned parallel with that of the platform sides and are spaced equally apart from one another to permit adequate support of uneven weight loads. In order to increase the usefulness of the platform, the platform is fitted with a piece of plywood sheathing 146 covering the entire area defined by the reinforced outer periphery 128. The cross braces and reinforced outer periphery are fabricated from metal, equivalent to the material used to fabricated the elongated vertical members. A plurality of guide wheels 148, preferably four, are rotatably coupled near the corners of the reinforced outer periphery and engage with that of the elongated vertical members to permit proper alignment of the platform 20 during the raising and lowering thereof.

A plurality of elongated braces are fixedly attached, preferably by a bolt and nut assembly commonly known to those skilled in the art, to the elongated vertical members to support the vertical members in a stable, upright position. In the preferred embodiment, six horizontal brace members 150, formed in an angular configuration, are fixedly attached to the top and bottom ends of the vertical members, and a pair of upper diagonal brace members 152 are fixedly attached to the first and third vertical members and the horizontal brace member located between the first and third vertical members. Note FIG. 1.

To increase stability of the storage platform and lift apparatus during use, a cross-shaped brace 154 is fixedly attached to the two horizontal brace members located between the second and fourth vertical members. Additional stability is accomplished by a pair of bottom diagonal brace members 156, which are fixedly attached to the second and fourth vertical members and the horizontal brace member located between the second and fourth vertical members. The cross-shaped brace is formed in a generally flat, rectangular configuration, while the bottom diagonal brace members are formed in a generally angular configuration. The cross-shaped and bottom diagonal brace members are fabricated from metal, equivalent to the material used to fabricate the vertical members, cross braces and reinforced outer periphery. To further enhance the stability of the apparatus during use, a plurality of apertures 158, preferably four, are included in each of the horizontal brace members located between the elongated vertical members. These apertures provide a means to screw the apparatus to a garage wall or similar mounting surface.

Referring now particularly to FIG. 4, first 28, second 30, third 32, and fourth cables 34, each being formed in an elongated cylindrical configuration, are positioned around the drive axle 26 between the disk-shaped dividers 116. The first cable 28 extends outwardly away from the drive axle over the top pulley wheel of the second vertical member and is coupled to the platform side positioned between the first and second vertical members. The second cable 30 extends downwardly away from the drive axle and is coupled to the platform side positioned between the third and fourth vertical members. The third cable 32 extends outwardly away from drive axle over the top pulley wheel of the first vertical member and is coupled to the platform side positioned between the first and second vertical members. The fourth cable 34 extends downwardly away from the drive axle and is coupled to the platform side positioned between the third and fourth vertical members.

In an operative orientation, a user releases the locking ratchet 104 and rotates the handle 86, which in turn, rotates the keyed gear shaft 84. This action sets in motion the lower and upper spur gears and ultimately the drive axle 26 which contains the four cables. By turning the handle clockwise, the platform 20 is raised to any one particular height. Similarly, by turning the handle counterclockwise, the platform is lowered to any one particular height. By engaging the locking ratchet with that of the locking ratchet gear and inserting the cylindrical pins 140 into the corresponding apertures of the elongated vertical members and reinforced outer periphery, the platform is secured at the desired height for either short- or long-term storage of machinery, equipment and the alike. Once the platform is situated and locked at the desired position by the user, another platform can be retrieved for additional storage of machinery, equipment and the alike using the same operating procedure previously mentioned.

As to the manner of usage and operation of the present invention, the same should be apparent from the description as described above. Accordingly, no further discussion relating to the manner and method of usage and operation will be included herein.

With respect to the above description then, it is to be realized that the optimum dimensional relationships for the parts of the present invention, to include variation in size, shape, materials, form, function, and the manner and method of operation, assembly and use, are deemed readily apparent and obvious to one skilled in the art, and all the equivalent relationships to those illustrated in the drawings and described in the specification are intended to be encompassed by the present invention.

While there has been shown and described a particular embodiment of the invention, it will be obvious to those skilled in the art that various changes and alterations can be made therein without departing from the invention and, therefore, it is aimed in the appended claims to cover all such changes and alterations as fall within the true spirit and scope of the invention.

What is claimed is:

1. A storage platform and lift apparatus comprising:

first and second elongated vertical members, each having a top end including a top pulley wheel rotatably coupled thereto;

a plurality of platforms, each having a reinforced outer periphery with two platform sides, each side having a pair of coupling means;

third and fourth elongated vertical members, each having a top end including a top bracket assembly attached thereto;

a plurality of elongated braces having ends fixedly attached to said vertical members to support said vertical members in an upright, stable position;

an elongated drive axle having a pair of ends, a keyed end and a distal end, said keyed and distal ends being rotatably engaged with top bracket assemblies of said third and fourth vertical members, said drive axle extending perpendicularly through said third vertical member;

means for raising and lowering said platforms from a static position; and first, second, third, and fourth cables, each cable being fixedly attached to and positioned around said axle, said first cable extending outwardly from said drive axle over said top pulley wheel of second vertical member and being coupled to said platform side positioned between said first and second vertical members, said second cable extending downwardly from said drive axle and being coupled to said platform side positioned between said third and fourth vertical members, said third cable extending outwardly from said drive axle over said top pulley wheel of said first vertical member and being coupled to said platform side positioned between said first and second vertical members, said fourth cable extending downwardly from said drive axle and being coupled to said platform side positioned between said third and fourth vertical members.

2. A storage platform and lift apparatus as set forth in claim 1, wherein said first, second, third, and fourth elongated vertical members are formed in a generally rectangular configuration and include a plurality of apertures extending therethrough.

3. A storage platform and lift apparatus as set forth in claim 1, wherein said platforms further comprise a plurality of cross braces formed in a generally rectangular configuration and a plurality of apertures extending through said reinforced outer periphery, said cross braces being positioned substantially parallel with that of said platform sides and spaced equally apart from one another to permit support of uneven weight loads.

4. A storage platform and lift apparatus as set forth in claim 1, said raising and lowering means comprises a lower drive gear assembly, an upper drive gear assembly and a drive gear chain, said lower drive gear assembly further comprises a box-like structure having plurality of walls, a lower spur gear, a keyed gear shaft, and a handle, said keyed gear shaft having an outboard end and extending through said walls of said box-like structure, said handle being fixedly attached to said outboard end to permit rotation of said lower spur gear about the longitudinal axis of said keyed gear shaft, said upper drive gear assembly comprising an upper spur gear and a gear hub positioned between said third vertical member and said upper spur gear, said upper spur gear being fixedly attached to said keyed end of said drive axle, said drive gear chain having a plurality of links in meshing communication with that of said lower and upper spur gears.

5. A storage platform and lift apparatus as set forth in claim 1, further comprising four disk-shaped dividers fixedly attached to and spaced about said drive axle so as to prevent entanglement of said cables positioned about and around said drive axle.

6. A storage platform and lift apparatus as set forth in claim 4, wherein said lower gear assembly further comprises a locking ratchet gear, a pair of lower gear spacers, a friction pad, a gear shaft stop, and a locking ratchet, said ratchet gear being formed in a generally circular configuration and having a plurality of protruding teeth extending radially therefrom, said teeth being in engagement with said locking ratchet to prevent rotation of said lower spur gear, said friction pad being positioned between one of said gear spacers and said wall of said box-like structure and having an aperture running therethrough so as to permit mounting onto said keyed gear shaft, said gear shaft stop being fixedly attached to said keyed gear shaft to prevent lateral movement of said keyed gear shaft while in rotational motion.

7. A storage platform and lift apparatus as set forth in claim 1, further comprising a plurality of guide wheels rotatably coupled to said reinforced outer periphery and engaged with that of said vertical members to permit proper alignment of said platform during the raising and lowering thereof.

8. A storage platform and lift apparatus comprising:

first and second elongated vertical members formed in a generally rectangular configuration with two side faces, an outer side face and an inner side face, each vertical member further including a plurality of apertures extending therethrough and a top end including a top pulley wheel rotatably coupled thereto;

a plurality of platforms, each being formed in a planer generally rectangular configuration and including a reinforced outer periphery with two platform sides, each side having a pair of coupling means;

third and fourth elongated vertical members formed in a generally rectangular configuration with two side faces, an outer side face and an inner side face, each vertical member further including a plurality of apertures extending therethrough and a top end including a top bracket assembly attached thereto, said third vertical member further comprising a lower drive gear assembly mounted onto a box-like structure having a plurality of walls, said box-like structure being positioned between said outer and inner side faces of said third vertical member, said lower drive gear assembly comprising a lower spur gear, a keyed gear shaft and a handle, said keyed gear shaft having an outboard end and extending through said wall of said box-like structure, said handle being fixedly attached to said outboard end to permit rotation of said lower spur gear about the longitudinal axis of said keyed gear shaft;

a plurality of elongated braces having ends fixedly attached to said elongated vertical members to support said elongated vertical members in an upright, stable position;

an elongated drive axle having a pair of ends, a keyed end and a distal end, and a plurality of disk-shaped dividers spaced about said drive axle, said keyed and distal ends being rotatably engaged with said top bracket assemblies of said third and fourth vertical members, said drive axle extending perpendicularly through said outer and inner side faces of said third vertical member, said drive axle further including an upper spur gear fixedly attached to said keyed end, said upper spur gear being positioned at said outer side face of said third vertical member;

a drive gear chain having a plurality of links in meshing communication with said lower and upper spur gears; and first, second, third, and fourth cables each being formed in an elongated cylindrical configuration, each cable being positioned around said drive axle between said dividers, said first cable extending outwardly away from said drive axle over said top pulley wheel of said second vertical member and being coupled to said platform side positioned between said first and second vertical members, said second cable extending downwardly away from said drive axle and being coupled to said platform side positioned between said third and fourth vertical members, said third cable extending outwardly away from said drive axle over said top pulley wheel of said first vertical member and being coupled to said platform side positioned between said first and second vertical members, said fourth cable extending downwardly away from said drive axle and being coupled to said platform side positioned between said third and fourth vertical members.

9. A storage platform and lift apparatus as set forth in claim 8, wherein said lower gear assembly further comprises a locking ratchet gear, a pair of lower gear spacers, a friction pad, a gear shaft stop, and a locking ratchet, said ratchet gear being formed in a generally circular configuration and having a plurality of protruding teeth extending radially therefrom, said teeth being in engagement with said locking ratchet to prevent rotation of said lower spur gear, said friction pad being positioned between one of said gear spacers and said wall of said box-like structure and having an aperture running therethrough so as to permit mounting onto said keyed gear shaft, said gear shaft stop being fixedly attached to said keyed gear shaft to prevent lateral movement of said keyed gear shaft while in rotational motion.

10. A storage platform and lift apparatus as set forth in claim 9, wherein said locking ratchet is rotatably attached to and spaced away from wall of said box-like structure by a ratchet spacer and an elongated ratchet bolt, said ratchet spacer and elongated ratchet bolt being configured to permit proper alignment for full engagement of said teeth of ratchet gear with that of said locking ratchet.

11. A storage platform and lift apparatus as set forth in claim 8, wherein said elongated braces further comprise a plurality of horizontal brace members, a pair of upper diagonal brace members and a pair of bottom diagonal brace members, said horizontal brace members being fixedly attached to said top and bottom ends of said vertical members, said upper diagonal brace members being fixedly attached to said first and third vertical members and said horizontal brace member located between said first and third vertical members, and said bottom diagonal brace members being fixedly attached to said horizontal brace members located between said first and second vertical members, said second and fourth vertical members, and said third and fourth vertical members.

12. A storage platform and lift apparatus as set forth in claim 8, wherein said elongated braces further comprise a cross-shaped brace having ends fixedly attached to said horizontal members located between said second and fourth vertical members.

13. A storage platform and lift apparatus as set forth in claim 12, wherein said cross-shaped brace is formed in a generally flat, rectangular configuration.

14. A storage platform and lift apparatus as defined in claim 12, wherein said horizontal members located between second and fourth vertical members include means for mounting said lift assembly to a garage wall or similar mounting surface so as to provide added stability to said vertical members.

15. A storage platform and lift apparatus as set forth in claim 8, further comprising a plurality of guide wheels rotatably coupled to said reinforced outer periphery and engaged with that of said vertical members to permit proper alignment of said platform during the raising and lowering thereof.

16. A storage platform and lift apparatus as set forth in claim 8, wherein each bracket assembly comprises a bearing housing, a bearing and a bearing collar, said bearing and bearing collar being formed in a generally circular configuration, said bearing being fitted within said bearing housing and around said drive axle to permit rotation of said drive axle at said third and fourth vertical members, said bearing collar being fitted around said drive axle to prevent lateral movement of said drive axle during rotation thereof.

17. A storage platform and lift apparatus as set forth in claim 8, wherein said platform further comprises a plurality of cross braces formed in a generally rectangular configuration and a plurality of apertures extending through said reinforced outer periphery, said cross braces being positioned substantially parallel with that of said platform sides and spaced equally apart from one another to permit support of uneven weight loads.

18. A storage platform and lift apparatus as set forth in claim 8, further comprising a plurality of elongated pins formed in a generally cylindrical configuration, said pins being situated within said apertures of said vertical members and said apertures of reinforced outer periphery to lock said platforms in a preferred static position.

19. A storage platform and lift apparatus as set forth in claim 8, wherein each of said platforms further comprises a sheet of plywood fixedly attached to said reinforced outer periphery.

20. A storage platform and lift apparatus comprising:

first and second elongated vertical members formed in a generally rectangular configuration with two side faces, an outer side face and an inner side face, each vertical member further including a plurality of apertures extending therethrough and a top end including a top pulley wheel rotatably coupled thereto;

a plurality of platforms, each being formed in a planer generally rectangular configuration and including a reinforced outer periphery with two platform sides, each side having a pair of coupling means, and a plurality of cross braces formed in a generally rectangular configuration, said reinforced outer periphery including a plurality of apertures extending therethrough and a plurality of guide wheels rotatably coupled to said reinforced outer periphery for engagement with that of said vertical members to permit proper alignment of said platform during the raising and lowering thereof, said cross braces being positioned substantially parallel with that of said platform sides and spaced equally apart from one another to permit support of uneven weight loads;

a plurality of elongated pins formed in a generally cylindrical configuration, said pins being situated within said apertures of said vertical members and said apertures of reinforced outer periphery to lock said platforms in a preferred static position;

third and fourth elongated vertical members formed in a generally rectangular configuration with two side faces, an outer side face and an inner side face, each vertical member further including a plurality of apertures extending therethrough and a top end including a top bracket assembly attached thereto, each bracket assembly comprising a bearing housing, a bearing and a bearing collar, said bearing and bearing collar being formed in a generally circular configuration, said bearing housing being configured to accept said bearing, said third vertical member further comprising a lower drive gear assembly and a locking ratchet assembly mounted onto a box-like structure having a plurality of walls, said box-like structure being positioned between outer and inner side faces of said third vertical member, said lower drive gear assembly comprising a lower spur gear, a locking ratchet gear having a plurality of protruding teeth extending radially therefrom, a keyed gear shaft, a pair of lower gear spacers, a gear shaft stop, a friction pad, and a handle, said gear shaft having an outboard end and extending through said wall of box-like structure, said handle being fixedly attached to said outboard end to permit rotation of said lower spur gear about the longitudinal axis of said keyed gear shaft and spaced away from said lower spur gear by a washer, said friction pad being positioned between said outer side face of said third vertical member and said gear shaft stop, said ratchet gear being positioned between said lower gear spacers to permit clearance of said ratchet gear while in rotational motion, said locking ratchet assembly comprising a locking ratchet, a ratchet spacer and an elongated bolt, said ratchet spacer and bolt being configured to permit alignment for full engagement of said teeth of locking ratchet gear with that of said locking ratchet;

a plurality of horizontal brace members having plurality of apertures extending therethrough to permit means to fixedly attach said lift apparatus to a wall, said horizontal brace members being fixedly attached to said vertical members to hold said vertical members in an upright, stable position;

a pair of upper diagonal brace members being fixedly attached to said top ends of said first and third vertical members and said horizontal brace member located between said first and third vertical members;

a pair of bottom diagonal brace members, one of which being fixedly attached to said horizontal brace member located between said first and second vertical members and said horizontal brace member located between said second and fourth vertical members, and another being fixedly attached to said horizontal brace member located between said third and fourth vertical members and said horizontal brace member located between said second and fourth vertical members;

a cross-shaped brace having ends fixedly attached to said horizontal members located between said second and fourth vertical members, said cross-shaped brace being formed in a generally flat, rectangular configuration;

an elongated drive axle having a pair of ends, a keyed end and a distal end, and a plurality of disk-shaped dividers spaced about said drive axle, said keyed and distal ends being rotatably engaged with top bracket assemblies of said third and fourth vertical members, said drive axle extending perpendicularly through said outer and inner side faces of said third vertical member, said drive axle further including an upper spur gear fixedly attached to said keyed end and spaced away from said outer side face of said third vertical member by a gear hub, said upper spur gear being positioned at said outer side face of said third vertical member and held in place by a shaft pin;

a drive gear chain having a plurality of links in meshing communication with said lower and upper spur gears; and first, second, third, and fourth cables each being formed in an elongated cylindrical configuration, each cable being positioned around said drive axle between said dividers, said first cable extending outwardly away from said drive axle over said top pulley wheel of said second vertical member and being coupled to said platform side positioned between said first and second vertical members, said second cable extending downwardly away from said drive axle and being coupled to said platform side positioned between said third and fourth vertical members, said third cable extending outwardly away from said drive axle over said top pulley wheel of said first vertical member and being coupled to said platform side positioned between said first and second vertical members, said fourth cable extending downwardly away from said drive axle and being coupled to said platform side positioned between said third and fourth vertical members.

* * * * *